US005771617A

United States Patent [19]

Baker

[11] Patent Number: 5,771,617

[45] Date of Patent: Jun. 30, 1998

[54] DISPLAY DEVICE

[75] Inventor: Paul Baker, Cheshire, United Kingdom

[73] Assignee: Gradus Limited, Cheshire, United Kingdom

[21] Appl. No.: 428,201

[22] PCT Filed: Nov. 4, 1993

[86] PCT No.: PCT/GB93/02276

§ 371 Date: Sep. 18, 1995

§ 102(e) Date: Sep. 18, 1995

[87] PCT Pub. No.: WO94/10673

PCT Pub. Date: May 11, 1994

[30] Foreign Application Priority Data

Nov. 5, 1992 [GB] United Kingdom ..... 9223223

[51] Int. Cl.[6] ..... G09F 13/22

[52] U.S. Cl. ..... 40/544; 40/565; 40/570; 264/272.14; 362/153; 362/238

[58] Field of Search ..... 40/544, 547, 565, 40/570; 264/1.9, 272.14; 362/153, 153.1, 238, 252

[56] References Cited

U.S. PATENT DOCUMENTS

| | | | |
|---|---|---|---|
| 2,213,708 | 9/1940 | Lange | 264/1.9 X |
| 4,106,231 | 8/1978 | MacNiel | 40/547 |
| 4,173,035 | 10/1979 | Hoyt | 362/252 X |
| 4,254,453 | 3/1981 | Mouyard et al. | 362/238 X |
| 4,697,950 | 10/1987 | Copeland | 362/153.1 X |
| 4,744,014 | 5/1988 | Harris | 362/153 X |
| 4,744,015 | 5/1988 | Lai | 362/153 |
| 4,794,373 | 12/1988 | Harrison | 362/153 X |
| 4,953,066 | 8/1990 | Schiffer | 362/252 |
| 4,967,317 | 10/1990 | Plumly | 40/570 X |
| 4,992,914 | 2/1991 | Heiss et al. | 362/153.1 |
| 5,027,258 | 6/1991 | Schoniger eta l. | 40/547 X |
| 5,095,412 | 3/1992 | French | 362/153 |
| 5,130,909 | 7/1992 | Gross | 362/153 |
| 5,151,679 | 9/1992 | Dimmick | 340/326 |
| 5,160,202 | 11/1992 | Legare | 362/153.1 |
| 5,162,696 | 11/1992 | Goodrich | 40/544 X |
| 5,404,282 | 4/1995 | Klinke et al. | 362/252 X |

FOREIGN PATENT DOCUMENTS

| | | | |
|---|---|---|---|
| 0422696 | 4/1991 | European Pat. Off. . | |
| 2417584 | 10/1974 | Germany . | |
| 8529956 | 7/1986 | Germany . | |
| 3915254 | 11/1990 | Germany . | |
| 88/02459 | 4/1988 | WIPO | 362/252 |

*Primary Examiner*—Brian K. Green
*Assistant Examiner*—Andrea Chop
*Attorney, Agent, or Firm*—Salter & Michaelson

[57] ABSTRACT

A display device that is incorporated into a building structure includes at least one rigid block composed of a robust grindable composition. The block has at least one light emitting device molded therein, the light emitting device being electrically connected to a power source to enable illumination of the light emitting device when in use. The light emitting device is visible from at least one surface of the block for providing at least one illuminated display surface in use. The block is incorporated within the building structure such that the display surface is exposed at and protrudes from at least one surface of the building structure. At least one surface of the block is ground to render visible the light emitting device for providing the display surface and to render the surface substantially non-slippery so as to prevent an object in contact with the display surface from slipping thereon in use. A method of making the display device is further disclosed.

8 Claims, 2 Drawing Sheets

DISPLAY DEVICE

BACKGROUND AND SUMMARY OF THE INVENTION

The present invention relates to a display and, in particular, to a display device which may be incorporated in the floors or walls of a building structure.

Conventional illuminated display devices such as strip tube with lights are generally designed for mounting on a wall or like surface and may be arranged to display messages. One problem with such devices is that they can be fragile and temperamental so that, unless mounted beyond normal reach, they are unsuitable for use in public areas. For example, an illuminated "FIRE EXIT" message of the conventional display device must be mounted in a position where an exiting crowd will not damage the display.

Furthermore, conventional display devices as described above are designed for normal indoor use and are consequently not suitable for outdoor, all-weather conditions, or for use under water. Generally, known outdoor type display devices are complicated, sealed structures designed for specific environments.

An object of the present invention is to provide a simple and convenient display device which overcomes the above-mentioned disadvantages.

According to a first aspect of the invention there is provided a display device comprising one or more illuminable devices embedded in a robust composition.

The robust composition may be an anti-slip composition as described in patent application number 9213885.8. This patent application discloses a composition for an anti-slip tread comprising an epoxy resin, a blocked polyurethane and an inert aggregate. The illuminable devices may be partially embedded so that the surfaces of the illuminable devices are visible at or above the surface of the robust composition. Alternatively, the illuminable devices may be wholly embedded and the surface of the robust composition may be ground until the illuminable device's surfaces are visible. Such grinding may include partial grinding of the illuminable device surfaces.

The illuminable devices may be incandescent bulbs, light-emitting diodes hereinafter referred to as LEDs, liquid crystal displays, optical fibres, laser diodes electroluminescent devices or the like and may be mounted on rigid or flexible printed circuit board (pcb), standard strip-board or wire loom.

Preferably the display device is in the form of one or more independent panels, each of which may be connected to a power supply via fly-leads or a conductor line and/or connected to a similar independent panel. The illuminable devices of each panel may be arranged to display a particular pattern, letter, numeral or symbol, and when interconnected, a number of such panels may combine to display a complete picture or message.

Alternatively, the display device may be in the form of a continuous strip. The illuminable devices may be mounted on a continuous strip of rigid or flexible pcb. In some applications the display device may be in the form of a single illuminable device embedded in a disc of robust composition.

Such a disc is particularly useful in for example precast concrete surfaces or terrazzo surfaces such as stairs or steps. The discs may be inlaid so that their surfaces are flush with the floor or wall surfaces. Alternatively, the discs may be partially or substantially raised above the surface to provide for example a non-slip or impact resistant tread.

Display devices of the invention in the form of continuous strips, with the illuminable devices preferably not grinded off, find particular application in the field of low location lighting such as in commercial premises and marine applications.

The display device of the invention may also be in the form of a small block which may fit within a suitably configured extrusion embedded or secured to a floor surface, carpet, skirting or the like. A miniature pcb having a single or multichip (for example four-orb) LED or other illuminable device mounted thereon may be encapsulated or embedded in the small block. Preferably a channel section extrusion having two grooves is provided to receive such display devices along the length thereof. The display devices may be connected in series in spaced apart relationship to form a discrete strip along the grooves. Alternatively the display devices may be connected adjacent each other and side by side in the grooves to form a display message or the like such as an EXIT sign located in the floor or carpet groove. A plastic or the like transparent or semi-transparent cover may be provided for the extrusion and a clip for example of metal may be provided to releasably retain the cover on the extrusion.

Preferably, and particularly for fire hazard locations, the robust composition comprises a fire and/or flame retardant material and any cables linking the display devices are coated with a suitable plastic such as polytetrafluoroethylene.

The illuminable devices may be connected electrically in series, in parallel or in series and parallel and each such device may be continuously or discretely illuminable, e.g. flashing LEDs. Thus, a single display device or part of a display device may include some illuminable devices connected in parallel and some connected in series. The display device composition and the illuminable devices may have any suitable color and preferably such coloring is chosen to provide high contrast between the illuminated illuminable devices and the background composition color. The robust composition may be wholly or partially transparent.

A layer of transparent material may be included between the illuminable devices and the surface of the display device composition. Such transparent material may be glass and may be ground to provide an anti-slip surface.

The display device may have any suitable shape, and, as described above, preferably forms a panel such as a floor or wall tile or is in the form of a disc, strip or small block. The display device may be shaped to form a stair nosing and the illuminable devices may be arranged to be visible from one or more surfaces of the robust composition.

According to a further aspect of the invention, there is provided a method of producing a display device comprising the steps of arranging one or more illuminable devices in a mold and forming a robust composition in the mold. Preferably such method includes the step of mounting such illuminable devices on a printed circuit board or the like prior arranging them in the mold.

Further steps may include arranging one or more transparent or semi-transparent sheets in the mold adjacent the surfaces of the illuminable devices and/or grinding the surface of the formed composition to enhance the anti-slip properties thereof.

The display device of the present invention is particularly suitable for use as an emergency exit guidance system. The low voltage supply makes the device electrically safe so that it can be used outdoors and in hazardous industrial situations.

The method of producing the display device is such as to provide a sealed unit which can safely be used under moist conditions such as on ships or underwater. The display device may include a robust composition which has enhanced fire-proof properties.

The display device can be fitted to floors, walls, curbs, skirtings, stairs, doors or the like by any suitable means including cementing, fixing by means of pre-drilled apertures and screws or adhesion.

BRIEF DESCRIPTION OF THE DRAWINGS

The invention will now be described further by way of example only and with reference to the accompanying drawings in which.

DETAILED DESCRIPTION OF THE PREFERRED EMBODIMENT

Figure 1:
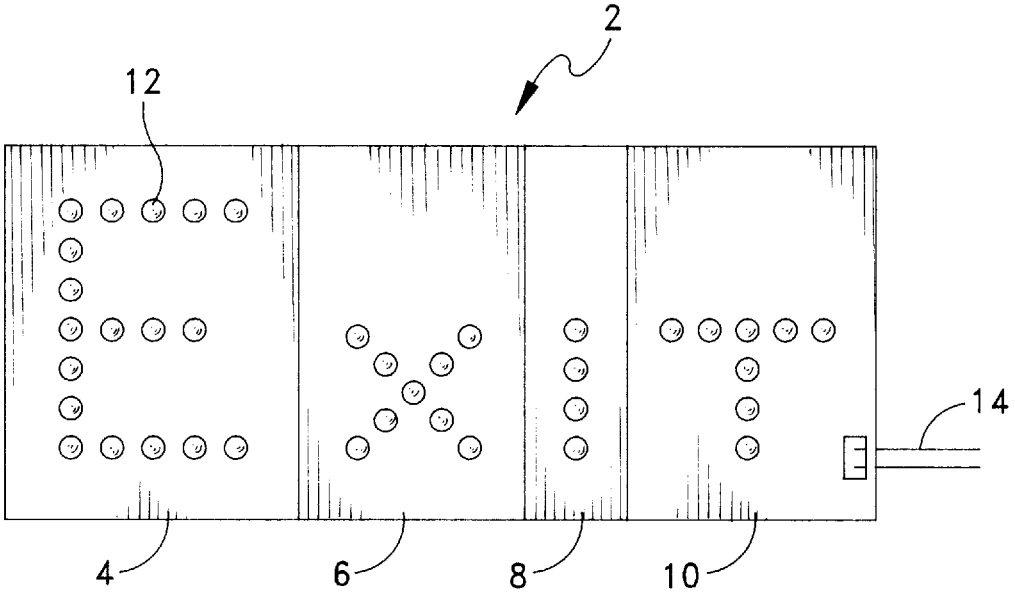
FIG. 1 illustrates one embodiment of the invention with connected panels.

Referring to FIG. 1 a display device 2 is comprised of four interconnected panels 4, 6, 8, 10, each displaying an individual letter E, X, I, T respectively. The letters are formed by appropriate arrangement of LEDs 12. Each panel is independent so that any number of panels may be connected to give any suitable message. Fly-leads 14 connect to a low voltage dc/ac power source.

Figure 2:
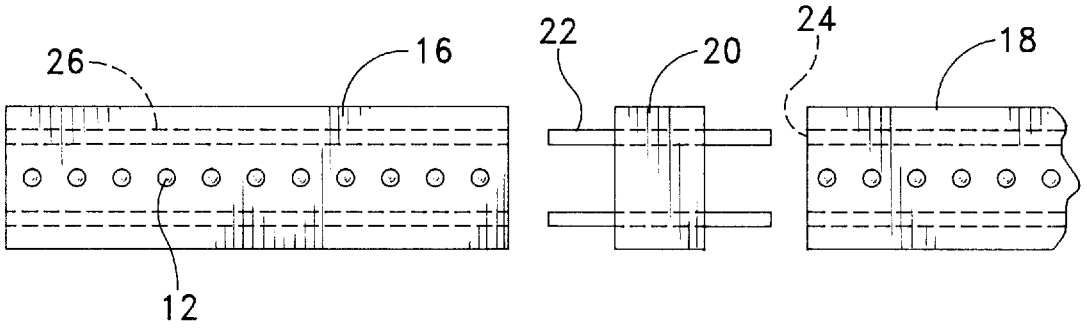
FIG. 2 shows a second embodiment of the invention with connecting means connecting successive panels.

FIG. 2 illustrates a connecting panel arrangement for use as a guideway system. LEDs 12 are incorporated in longitudinal panels 16, 18 which are connected by means of connector 20 so that the LEDs form a continuous guideway. The connector 20 has prongs 22 which mate with corresponding apertures 24 in the end walls of the panels 16, 18. Conductors 26 may be hollow or solid. The prongs 22, apertures 24 and conductors 26 form a continous bus line when the panels are connected. The dc/ac power source may be located either locally or remotely at one end of the guideway system.

Figure 3:
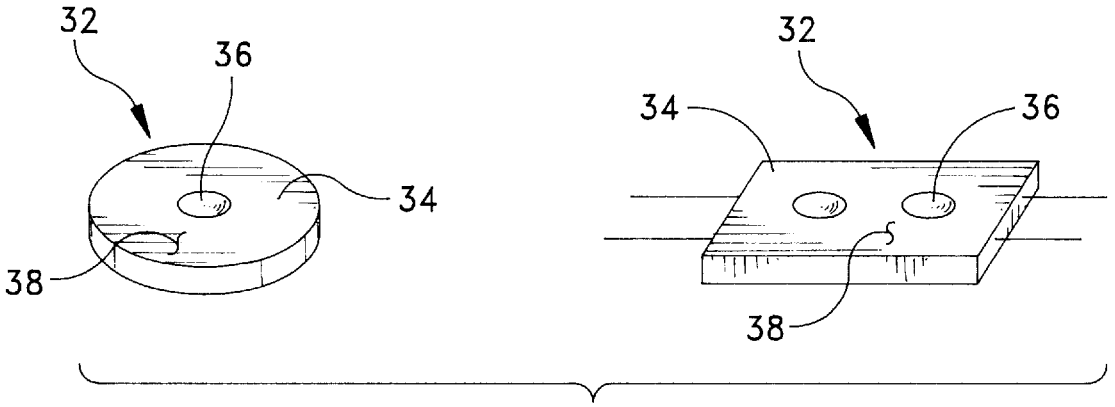
FIG. 3 shows alternative embodiments of display device of the invention.

FIG. 3 illustrates further embodiments of display device 32 having suitably shaped robust compositions 34 and embedded LEDs 36. As shown, the robust composition 34 is in the form of a circular or rectangular shaped block, each having a surface 38 which is ground so as to render visible the LED 36 and to render the surface substantially non-slippery so as to prevent an object in contact with the display surface from slipping thereon in use.

Figure 4:
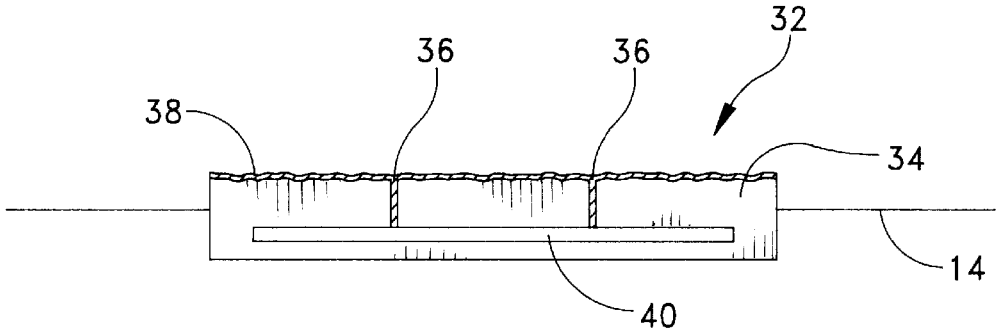
FIG. 4 shows a printed circuit board embedded within the robust composition.

FIG. 4 illustrates a block similar to the ones shown in FIG. 3 wherein a printed circuit board (PCB) 40 is embedded within the robust composition 34. As shown, the LEDS 36 are mounted on the PCB 40 in such a manner that they extend upwardly through and out of the robust composition 34.

Figure 5:
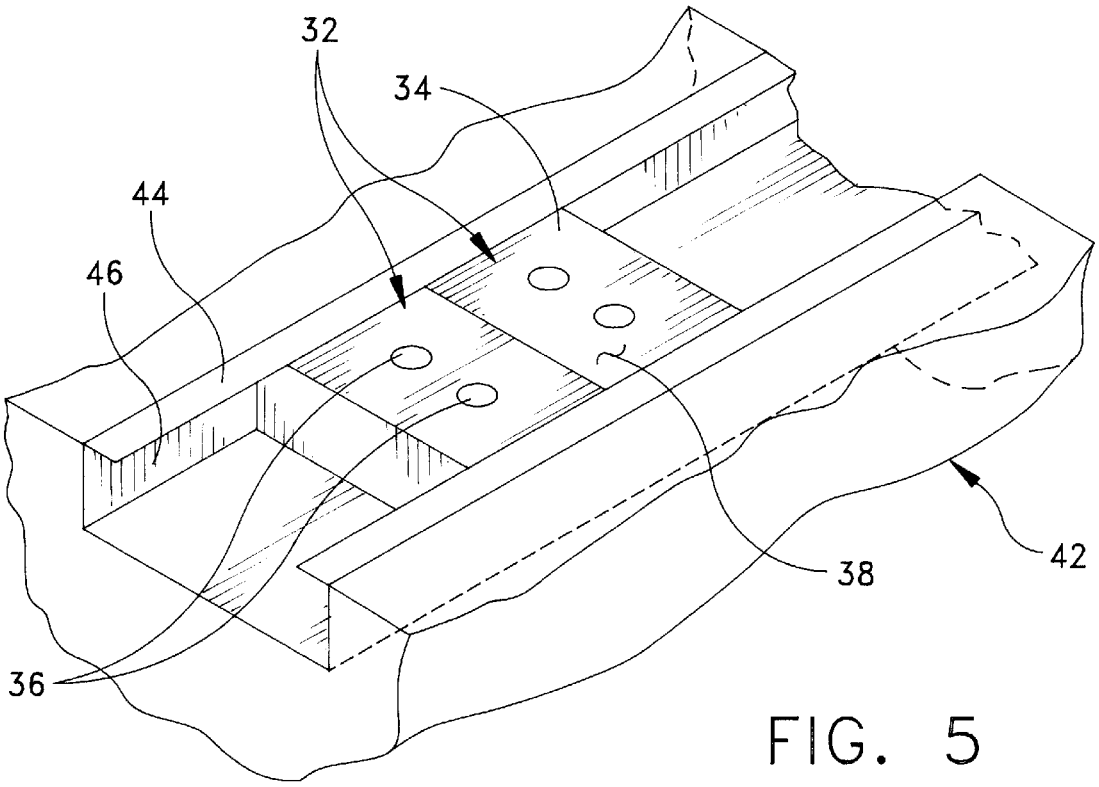
FIG. 5 shows the display device incorporated within a building structure.

FIG. 5 illustrates a building structure generally indicated at 42 having a display device 32 with its display surface 38 protruding through the building structure. An extruded body 44 having a groove 46 formed therein is shaped to receive the block (robust composition 34) of the display device 32. Preferably, the body 44 together with the block 34 is incorporated within the building structure 42.

In manufacture, the LEDs are mounted either in series or in parallel on a PCB or the like and the whole circuit is embedded in the panel by molding the panel around it. Some of the LEDs may be mounted in parallel while some may be mounted in series over the whole or part of the PCB or like support structure. The surface of the panel is ground down so that the LEDs are displayed and the non-slip properties of the surface are enhanced.

It will be appreciated that the present invention is not intended to be restricted to the details of the above described embodiment which is described by way of example only. In particular, any suitable hard wearing material may be used in the molding process and the illuminated devices may be arranged in one or more panels or strips to form any required message or pattern for display.

What is claimed is:

1. A display device that is incorporated into a building structure, the display device comprising at least one rigid block composed of a robust grindable composition, the block having at least one light emitting device molded therein, the light emitting device being electrically connected to a power source to enable illumination of the light emitting device when in use, the light emitting device being visible from at least one surface of the block for providing at least one illuminated display surface in use, the block being incorporated within the building structure such that the display surface is exposed at, and protrudes from at least one surface of the building structure, at least one surface of the block being ground to render visible the light emitting device for providing said display surface and to render the surface substantially non-slippery so as to prevent an object in contact with the display surface from slipping thereon in use.

2. A display device as set forth in claim 1, the robust composition being substantially non-flammable.

3. A display device as set forth in claim 1, the light emitting device being mounted on a printed circuit board.

4. A display device as set forth in claim 3, the printed circuit board being embedded in the block.

5. A display device as set forth in claim 1, the block being in the form of a disc.

6. A display device as set forth in claim 1, the block being adapted to be received in an extruded body having a correspondingly shaped groove therein, the body together with the block being incorporated within the building structure.

7. A method of producing a display device for incorporation into a building structure comprising the steps of:

arranging at least one light emitting device in a mold;

molding a grindable robust composition around the light emitting device such that the light emitting device is embedded in the robust composition to form a block; and grinding at least one surface of the block to render visible the light emitting device for providing at least one display surface in use and to render the display surface substantially non-slippery so as to prevent an object in contact with the display surface from slipping thereon in use.

8. A method as set forth in claim 7, further comprising the step of mounting the light emitting device on a printed circuit board before arranging the light emitting device in the mold.

* * * * *